US007451718B2

(12) United States Patent
Boatman et al.

(10) Patent No.: US 7,451,718 B2
(45) Date of Patent: Nov. 18, 2008

(54) MOORING ARRANGEMENT WITH BEARING ISOLATION RING

(75) Inventors: L. Terry Boatman, Spice Wood, TX (US); Stephen P. Lindblade, Waller, TX (US)

(73) Assignee: SOFEC, Inc., Houston, TX (US)

( * ) Notice: Subject to any disclaimer, the term of this patent is extended or adjusted under 35 U.S.C. 154(b) by 0 days.

(21) Appl. No.: 12/012,406

(22) Filed: Jan. 31, 2008

(65) Prior Publication Data

US 2008/0182467 A1 Jul. 31, 2008

Related U.S. Application Data

(60) Provisional application No. 60/887,538, filed on Jan. 31, 2007.

(51) Int. Cl.
*B63B 21/00* (2006.01)

(52) U.S. Cl. ..... 114/230.12; 441/3

(58) Field of Classification Search ..... 441/3–5; 114/230.12

See application file for complete search history.

(56) References Cited

U.S. PATENT DOCUMENTS 3,440,671 A 4/1969 Smulders
4,359,959 A * 11/1982 Delamare ..... 114/230.15
4,660,494 A 4/1987 Doré et al.
4,802,431 A 2/1989 Pollack
4,892,495 A 1/1990 Svensen
5,044,297 A 9/1991 de Baan et al.
5,065,689 A 11/1991 Krogstad
5,266,061 A 11/1993 Poldervaart et al.
5,305,703 A 4/1994 Korsgaard
5,339,760 A 8/1994 Korsgaard
5,356,321 A * 10/1994 Boatman et al. ..... 441/3
5,363,789 A 11/1994 Laurie et al.
5,380,229 A 1/1995 Korsgaard
5,456,622 A 10/1995 Breivik et al.
5,468,166 A 11/1995 Breivik et al.
5,509,838 A 4/1996 Breivik et al.
5,529,521 A 6/1996 Breivik et al.
5,540,607 A 7/1996 Breivik et al.
5,545,065 A 8/1996 Breivik et al.
5,564,957 A 10/1996 Breivik et al.
5,628,657 A 5/1997 Breivik et al.
5,651,708 A 7/1997 Børseth
5,697,732 A 12/1997 Sigmundstad
5,749,758 A 5/1998 Breivik et al.
5,782,197 A * 7/1998 Pollack ..... 114/230.12

(Continued)

*Primary Examiner*—Stephen Avila
(74) *Attorney, Agent, or Firm*—Gary L. Bush; Andrews Kurth LLP

(57) ABSTRACT

Apparatus for mooring a vessel to the seabed comprising a turret that is connected to the vessel for rotation about a vertical axis defined thereby and axial/radial bearing structure that can absorb axial and radial forces. The turret is connected at its lower end to a chain table or buoy for attaching mooring lines. The turret is disposed inside the hull of the vessel within a fixed tube. An outer ring of the axial/radial bearing is mounted to a rigid ring, which in turn is fastened by a flexible tube to the lower end of the fixed tube at an elevation below the rigid ring. The fixed tube encloses the turret with clearance. Deformation of the hull due to wind and waves is inhibited to the bearing, because hull deformation is absorbed by the flexible tube that couples the rigid ring to the vessel hull.

6 Claims, 4 Drawing Sheets

U.S. PATENT DOCUMENTS

| | | | | |
|---|---|---|---|---|
| 5,839,387 | A | 11/1998 | Myklebust | |
| 5,913,279 | A | 6/1999 | Braud et al. | |
| 5,941,746 | A | 8/1999 | Isnard et al. | |
| 5,951,345 | A | 9/1999 | Perratone et al. | |
| 5,957,074 | A | 9/1999 | de Baan et al. | |
| 5,957,076 | A | 9/1999 | Pollack et al. | |
| 5,983,931 | A | 11/1999 | Ingebrigtsen et al. | |
| 6,053,787 | A | 4/2000 | Erstad et al. | |
| 6,070,548 | A | 6/2000 | Ducousso et al. | |
| 6,155,193 | A | 12/2000 | Syvertsen et al. | |
| 6,164,233 | A | 12/2000 | Pollack et al. | |
| 6,176,193 | B1 | 1/2001 | Whitby et al. | |
| 6,199,500 | B1 | 3/2001 | Børseth | |
| 6,200,180 | B1 | 3/2001 | Hooper | |
| 6,250,243 | B1 | 6/2001 | Wierli et al. | |
| 6,263,822 | B1 * | 7/2001 | Fontenot et al. | 114/230.12 |
| 6,269,762 | B1 | 8/2001 | Commandeur | |
| 6,302,048 | B1 | 10/2001 | Smedal | |
| 6,315,625 | B1 | 11/2001 | Braud | |
| 6,347,598 | B1 * | 2/2002 | Fontenot et al. | 114/230.13 |
| 6,474,252 | B1 | 11/2002 | Delago | |
| 6,502,524 | B1 | 1/2003 | Hooper | |
| 6,517,290 | B1 | 2/2003 | Poldervaart | |
| 6,543,376 | B1 | 4/2003 | Breivik et al. | |
| 6,698,372 | B2 | 3/2004 | Hobdy et al. | |
| 6,701,981 | B1 | 3/2004 | Olsen | |
| 6,736,082 | B2 | 5/2004 | Breivik et al. | |
| 6,990,917 | B2 * | 1/2006 | Boatman et al. | 114/230.12 |
| 2002/0073906 | A1 * | 6/2002 | Hobdy et al. | 114/230.12 |
| 2004/0029464 | A1 | 2/2004 | Pollack et al. | |
| 2004/0261682 | A1 | 12/2004 | Lindblade et al. | |
| 2004/0261683 | A1 | 12/2004 | Lindblade et al. | |
| 2007/0264889 | A1 | 11/2007 | Boatman et al. | |

* cited by examiner

MOORING ARRANGEMENT WITH BEARING ISOLATION RING

This application claims priority benefit from provisional application 60/887,538 filed in the U.S. Patent and Trademark Office on Jan. 31, 2007.

BACKGROUND OF THE INVENTION

1. Field of the Invention

This invention concerns turret mooring systems for loading and offloading liquid petroleum product oil tankers, floating storage (FSO) vessels, floating production storage and offloading (FPSO) systems, floating vessels for natural gas offloading (for example, cryogenic liquefied natural gas (LNG) regas import terminals), and LNG transport vessels. Specifically, the invention is employed in a vessel with a mooring system having a tube or closed turret that is mounted inside the vessel hull by a bearing structure that can withstand axial and radial deformation forces from wind, waves and currents.

2. Description of the Prior Art

In the offshore hydrocarbon production industry, cost considerations have led to the use of floating, production, storage and offloading and similar vessels coupled to subsea wells via one or more risers. Turret-moored vessels are free to weathervane, and they use one or more production swivels to couple shipboard conduits to the fixed risers that run between the swivels and the sea floor. Numerous configurations of vessels moored by internal turrets or tubes are known in the art.

The dynamic weather, sea states, tides, and currents cause the vessel to pitch, roll, heave, fall and rotate, and the resultant forces are transferred to the mooring system. The environmental forces acting on the vessel cause the vessel to weathervane because the turret is axially and radially supported from the vessel by one or more bearing assemblies. During pitching, yawing and rolling of the vessel under the influence of the wind, waves, and currents, the hull of the vessel bends and twists, possibly deforming the bearing assemblies and thus hampering free rotation of the vessel.

In addition to force considerations, the size and structure of turret bearings are affected by the number and size of the risers or conduits which must pass through the turret. Although FPSOs were originally conceived to exploit smaller oil fields and to convert an existing small or medium size oil tanker to a FPSO, there is a trend to connect as many subsea wellheads as possible to FPSOs. As a result, very large tankers are being converted to turret-moored FPSOs. A floating vessel is not a static structure but rather the structure is subjected substantial bending and twisting. Therefore, a bearing assembly rigidly connected to a large vessel may be subjected to great oval shaped deformations.

In response, turrets employing non-precision bearings designed with adequate "play" to accommodate such deformations have been used. For example, U.S. Pat. No. 3,440,671 issued to Smulders provides within the hull of a vessel a cylindrical hollow chamber, in which is disposed a moored, buoyant tubular element with sets of wheels fitted at intervals along its periphery and arranged to roll within roller tracks within the chamber, thus permitting turning of the vessel with respect to the tubular element. The cylindrical chamber may become deformed to an oval shape under certain load conditions. However, because the self-adjusting sets of wheels provide sufficient play to tolerate such deformation, the bearing arrangement permits rotation even when deformation of the cylindrical tube walls occurs.

Although non-precision bearings accommodate deflection, they typically have more friction than corresponding precision ball or roller bearings (when not deformed by hull loading). If precision ball and roller bearings are used in a mooring configuration such that they are not subject to deformation, it is possible for the vessel to turn with minimum resistance about the geostationary turret tube. Due to deformation, however, larger, more robust precision bearings are typically required, with resulting higher cost.

U.S. Pat. No. 5,266,061 issued to Poldervaart et al. discloses an arrangement designed to reduce the deformation forces applied to the turret bearing, and thus to allow smaller less expensive precision bearings to be used. The Poldervaart et al. arrangement is shown in FIG. 1 of the drawings appended hereto. The vessel (1) is equipped with a vertical cylindrical tube (3) forming a hollow chamber extending substantially the height of the vessel from the keel (7) to the main deck (5). The upper portion of the tube (3) is fixed to the hull (2). The hull (2) includes a moon pool (9) into which a downwardly projecting lower end portion (11) of tube (3) extends a substantial distance. The hull (2) joins the tube (3) above the lower end (11) of the tube (3) and closes the top of the moon pool (9) as shown in FIG. 1. The lower end (11) is spaced away from the side walls (8) of moon pool (9) and from the hull (2) of the vessel (1).

A rigid ring (13) is secured to the inside of the lower end of lower end (11) of tube (3). A vertical rotary tube or turret (15, 16) having a lower portion (15) and an upper portion (16) is supported on rigid ring (13) by an axial/radial bearing (17). The bearing (17) has an outer race secured to ring (13) and an inner race secured to lower portion (15) of the turret (15, 16). At its lower end, lower portion (15) of turret (15, 16) carries a chain table (19) to which are secured anchor chains (21), by which the vessel is moored to the sea floor. Turret (15, 16) is hollow from top to bottom. Conduits (23, 25) extend vertically therethrough to serve as gas and hydrocarbon product risers and the like.

In operation, the vessel (1) is moored to a relatively fixed position by anchor chains (21) so that gaseous and/or liquid products can rise through conduits (23, 25) for storage onboard the vessel (1) or transportation to shore. Despite the location of the mooring system generally amidships, which subjects it to minimum influence from pitching and yawing of the vessel, the fixed tube (3) may deformed where it is connected to the hull. An undeflected fixed tube (3) is shown by the horizontal cross section of tube (3) in FIG. 2, with the dashed lines (3') representing ovaling deformation of tube (3). The deformation forces are not transmitted to rigid ring (13), because the downwardly projecting portion (11) of fixed tube (3) between the hull and ring (13) is not secured to the hull and is therefore free to deform at its upper end while not significantly affecting its lower end. The rigid ring (13) holds the lower end of projection (11) against deformation and, more importantly, prevents deformation of the outer bearing race of bearing (17). The inner race of bearing (17) is not subjected to deformation by hull stress because it is not connected to the hull other than by the outer ring of bearing (17).

While the Poldervaart et al. arrangement serves to isolate the turret bearing from hull deformation, the hull of an ordinary ship requires extensive vessel structural modifications to construct a moon pool (9) in order to install the mooring system, thus adding cost.

3. Identification of Features Provided by Some Embodiments of the Invention

A primary object of the invention is to provide a vessel with a mooring arrangement having a precision bearing arrangement that is isolated from stresses of hull deformation.

SUMMARY OF THE INVENTION

The objects identified above, as well as other features of the invention are incorporated in a mooring apparatus having a rotary tube or turret disposed within a cylinder which is fixed to the vessel. The cylinder is fixed to the vessel at an upper deck and at the keel. The mooring arrangement includes an axial bearing or a combined radial/axial bearing with an outer ring or race fixed to a stiff, rigid ring, which in turn is fastened to the lower end of the fixed cylinder by a flexible tube and lower hull plate. The flexible tube mitigates deflections and dampens stresses from the hull at the rigid ring, and the stiff rigid ring prevents deformation of the bearing assembly from those dampened hull stresses. In other words, between the rigid ring that supports the turret bearings and the hull of the vessel, there is a substantial vertical length of flexible tube that is subject at its lower end to the deformations imposed by deformation of the hull but does not, at its upper end, pass along deformation stress to the rigid ring in such magnitude as to deform the rigid ring, and with it the outer ring or race of the bearing. The flexible tube serves as a deformable sleeve to absorb the deformations imposed by the hull rather than passing those deformations along to the rigid ring.

Because no force of deforming magnitude acts on the outer bearing ring, the arrangement of the present invention allows a turret or rotary tube with a precision ball or roller bearing structure to be positioned inside the vessel hull anywhere between the bow and the stern.

BRIEF DESCRIPTION OF THE DRAWINGS

The invention is described in detail hereinafter on the basis of the embodiments represented in the accompanying figures, of which.

DESCRIPTION OF THE PREFERRED EMBODIMENT OF THE INVENTION

Figure 1:
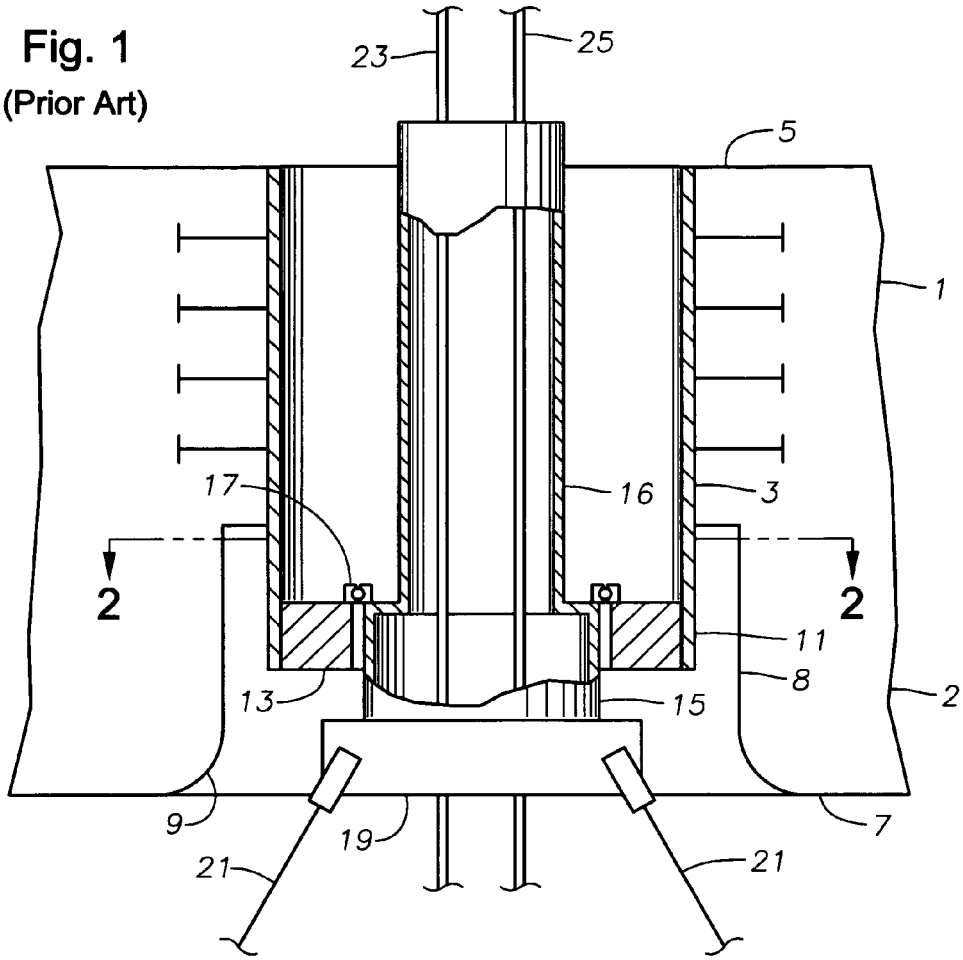
Fig. 1 (Prior Art)
FIG. 1 is a cross section of a prior art mooring arrangement taken along a vertical longitudinal slice of the vessel showing an inner cylinder, which is fixed to a geostationary chain table and rotatively connected by a ball bearing/rigid ring assembly to an outer cylinder, which is in turn fixed to the vessel at a distance substantially above the rigid ring.
Figure 2:
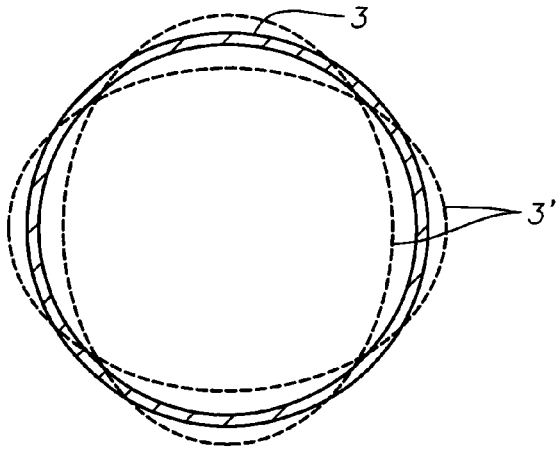
Fig. 2 (Prior Art)
FIG. 2 is a horizontal cross section of the prior art mooring arrangement of FIG. 1 taken along lines 2-2 of FIG. 1 showing deflected shapes of the outer tube fixed to the vessel hull due to the forces of wind and waves.
Figure 3:
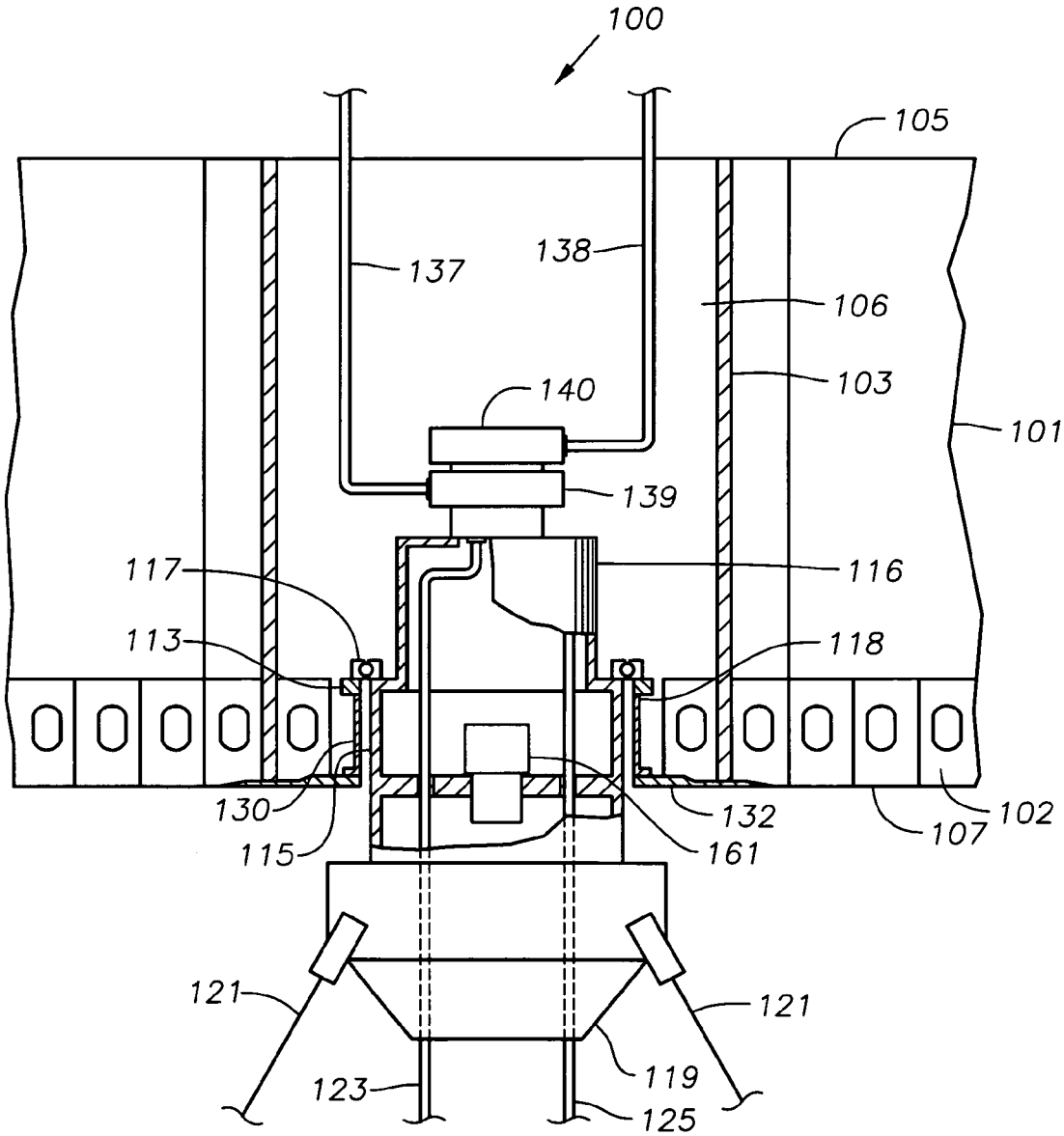
FIG. 3 is a simplified cross section of a mooring system with a detachable buoy according to a first embodiment of the invention taken along a vertical longitudinal slice of the moored vessel, showing an inner cylinder, which is fixed to the geostationary buoy, rotatively connected by a ball bearing/rigid ring assembly to an outer cylinder, which is in turn fixed to the vessel at a distance substantially below the rigid ring.

FIG. 3 illustrates a cross section of a mooring system with a detachable buoy according to a first embodiment of the invention. The vessel 101 includes a vertical cylindrical tube 103 forming a hollow chamber 106 which extends the height of the vessel from the keel 107 to the main deck 105. The cylindrical tube 103 is preferably located along a vessel longitudinal axis generally between the bow or stern of the vessel, preferably closer to the bow or stern than, at mid ship. Tube 103 is structurally fixed within the hull 102 of vessel 101 and defines a fluid transfer system (FTS) compartment 100.

A vertical rotary tube or turret 115, 116 includes a lower portion 115 and an upper portion 116. The turret 115, 116 is coaxially aligned with fixed tube 103. The turret 115, 116 is rotatively connected to the hull 102 via a precision axial/radial bearing 117, which is connected to a stiff, rigid ring 113, which is connected to a flexible tube 130, which is connected to a hull lower plate 132. The bottom of hull 102 is attached to the outer perimeter of ring-shaped hull lower plate 132, which dynamically deflects into an oval shape due to hull flexure. The inner perimeter of hull lower plate 132 is in turn connected to the bottom end of flexible tube 130, which is deformable to mitigate deflections imparted by lower hull plate 132. The upper end 118 of flexible tube 130 is connected to the stiff, rigid ring 113 that serves to prevent any deflection of bearing 117. Flexible tube 130 is tall enough and flexible enough to prevent ovaling forces large enough to deform rigid ring 113 from being transferred from plate 132 to ring 113. Although rigid ring 113 is shown as a solid member it may have a hollow or ribbed construction in the form of a box section, for example, or other appropriate rigid structure. Rigid ring 113 is connected to the outer race of bearing 117. Turret 115, 116 is connected to the inner race of bearing 117. Bearing 117 is preferably a roller, ball or sliding bearing, although other bearing types may also be used.

The lower end of lower turret 115 includes a structural connector 161 for detachably connecting a geostationary mooring buoy or chain table 119, to which are secured anchor chains 121, by which the vessel is moored to the sea floor. Accordingly, turret 115, 116 is geostationary with vessel 102 capable of weathervaning about it. Conduits 123 and 125 extend vertically through turret 115, 116 and buoy 119 to serve as gas and hydrocarbon product risers, for example. Conduits 123, 125, which are geostationary, fluidly connect to shipboard conduits 137, 138, which weathervane by fluid swivels 139, 140, respectively. Mooring buoy 119 is designed to sink to a stable depth beneath the sea surface when disconnected from turret 115, 116, so that vessel 101 may sail away or return for re-connection to the buoy 119.

Figure 4:
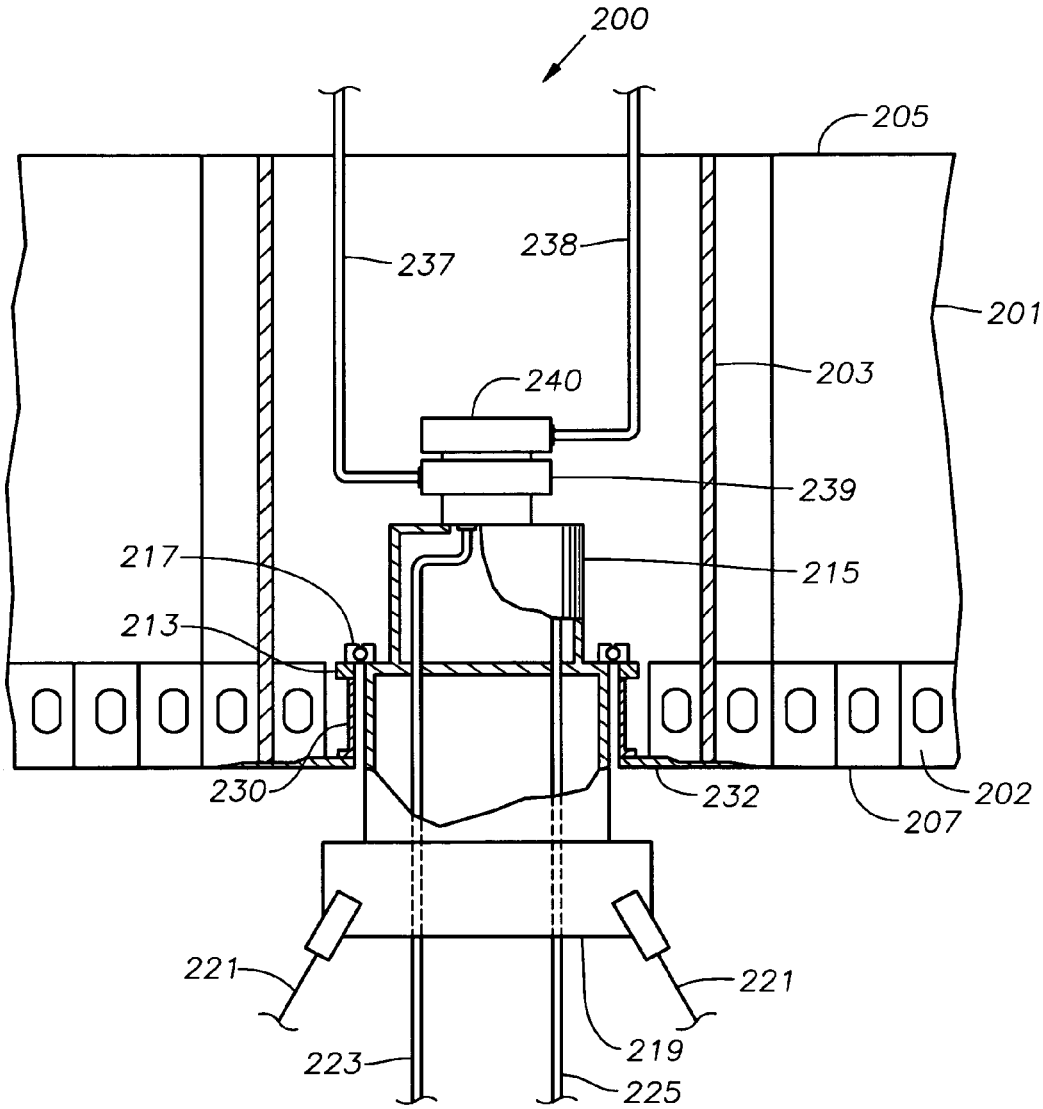
FIG. 4 is a simplified cross section of a mooring system without a detachable buoy according to a second embodiment of the invention taken along a vertical longitudinal slice of the moored vessel, showing an inner cylinder, which is fixed to the geostationary chain table, rotatively connected by a ball bearing/rigid ring assembly to an outer cylinder, which is in turn fixed to the vessel at an elevation well below the rigid ring.

FIG. 4 is a simplified cross section of a mooring system without a detachable buoy according to a second embodiment of the invention. The embodiment of FIG. 4 is substantially identical to the embodiment of FIG. 3 except that the turret 215 is connected directly to a chain table 219 without a structural connector for rapid disconnection of the vessel from its moorings. Vessel 201 includes a vertical cylindrical tube 203 forming a hollow chamber extending the height of the vessel from the keel 207 to the main deck 205. The cylindrical tube 203 is preferably located along the vessel's longitudinal axis generally amidships, but it may be located longitudinally anywhere between the bow and the stern. Tube 203 is structurally fixed within the hull 202 of vessel 201 and defines a fluid transfer system (FTS) compartment 200.

Vertical rotary tube or turret 215 is coaxially disposed in fixed tube 203. Turret 215 is rotatively connected to hull 202 by a precision axial/radial bearing 217, rigid ring 213, flexible tube 230, and hull lower plate 232. The bottom of hull 202 is attached to the outer perimeter of ring-shaped hull lower plate 232, which dynamically deflects into an oval shape due to hull flexures. The inner perimeter of hull lower plate 232 is in turn connected to the bottom end of flexible tube 230, which is deformable to mitigate deflections imparted by lower hull plate 232. The upper end of flexible tube 230 is connected to a stiff, rigid ring 213 that serves to prevent any deflection of bearing 217. Flexible tube 230 is tall enough to provide adequate dampening to large deforming forces so as to prevent deformation of rigid ring 213. Although rigid ring 213 is shown as a solid member it may have a hollow or ribbed construction, for example, in the form of a box section, or other appropriate rigid structure. Rigid ring 213 is connected to the outer race of bearing 217, and turret 215 is connected to the inner race of bearing 217. Bearing 217 is preferably a roller, ball or sliding bearing, although other bearing types may also be used.

The lower end of lower turret 215 is connected to chain table 219, to which are secured anchor chains 221, by which the vessel is moored to the sea floor. Turret 215 and chain table 219 house conduits 223 and 225 that extend vertically therethrough to serve, e.g., as gas and hydrocarbon product risers. Conduits 223, 225, which are geostationary, fluidly connect to shipboard conduits 237, 238, which weathervane, by fluid swivels 239, 240, respectively.

Figure 5:
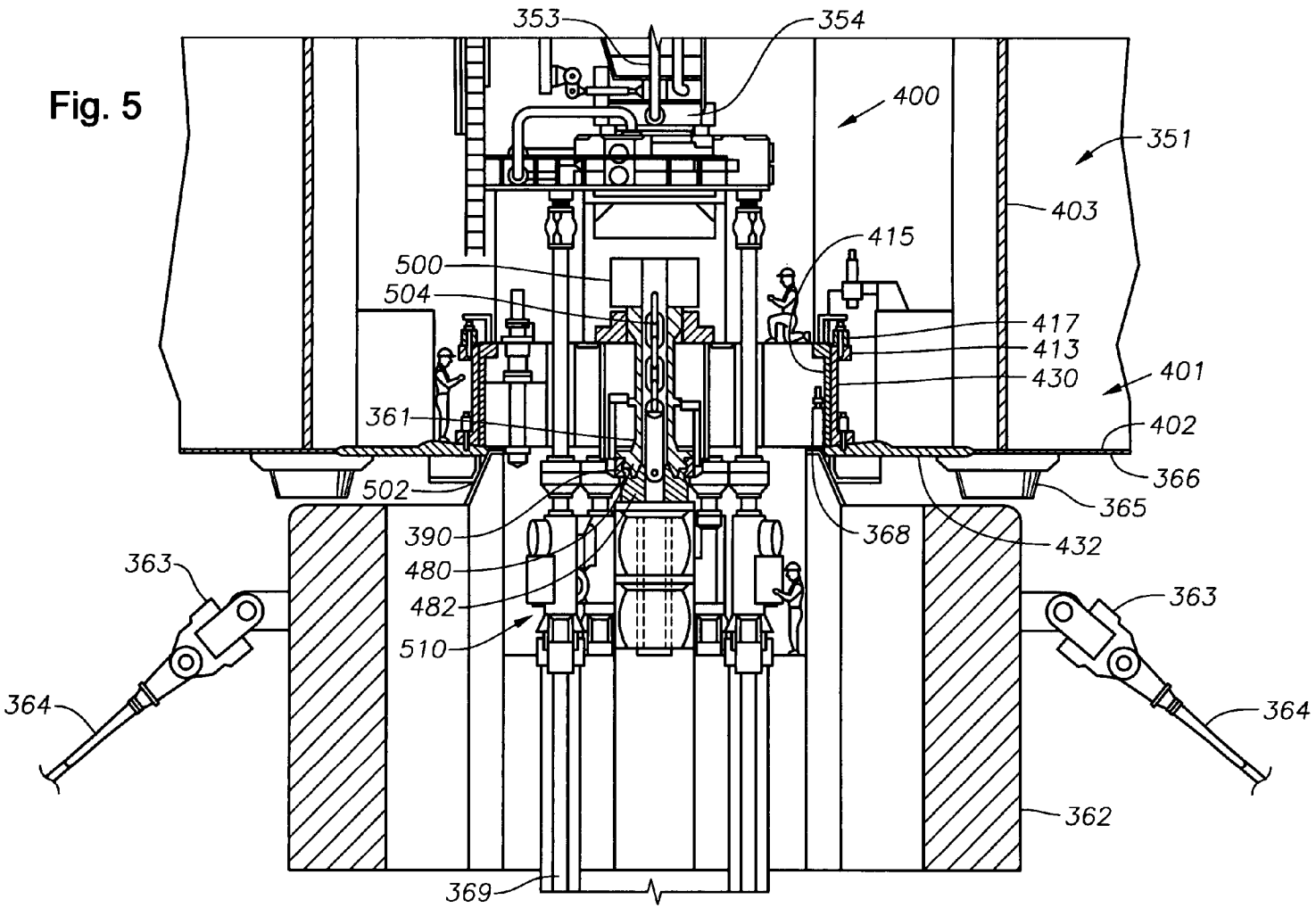
FIG. 5 is a detailed cross section of a mooring system with detachable buoy of FIG. 3 further illustrating a chain tensioning device for connecting the mooring buoy and a quality control/damage control room located in the buoy and extending below the keel of the ship.

FIG. 5 shows a detailed cross section of a mooring system with a detachable buoy like that of FIG. 3 and illustrates an embodiment of a mooring and fluid transfer system 351 according to the invention. Vessel 401 includes a vertical cylindrical tube 403 forming a hollow chamber extending the height of the vessel from the keel 366 to the main deck (not illustrated). The cylindrical tube 403 is preferably located along the vessel's longitudinal axis generally between the bow and stem but preferably closer to the bow or stem to make weathervaning easier. Tube 403 is structurally fixed within the hull 402 of vessel 401 and defines a fluid transfer system (FTS) compartment 400. Detachable buoy 362 is rotatively fastened to the keel 366 of vessel 401 via connections of a structural connecter 361, turret 415, precision axial/radial bearing 417, rigid ring 413, flexible tube 430, and hull lower plate 432.

Vertical rotary tube or turret 415 is coaxially placed within fixed tube 403. Turret 415 is rotatively connected to hull 402 via a connection path of a precision axial/radial bearing 417, rigid ring 413, flexible tube 430, and hull lower plate 432. The keel 366 is attached to the outer perimeter of ring-shaped hull lower plate 432, which may dynamically deflect into an oval shape due to hull flexures. The inner perimeter of hull lower plate 432 is connected to the bottom end of flexible tube 430, which is deformable to mitigate deflections imparted by lower hull plate 432. The upper end of flexible tube 430 is connected to a stiff, rigid ring 413 that serves to prevent ovaling of bearing assembling 417. Flexible tube 430 is sufficiently tall and flexible to provide adequate dampening from ovaling forces at the bottom of tube 430 from being transferred to the top of tube 430. Although rigid ring 413 is shown as a solid member, it may have a hollow or ribbed construction in the form of a box section, for example, or other appropriate rigid structure. Rigid ring 413 is connected to the outer race of bearing 417. Turret 415 is connected to the inner race of bearing 417. Bearing 417 is preferably a roller, ball or sliding bearing, although other bearing types may also be used.

Rubber fenders 365 are preferably provided on vessel 401 or buoy 362 to cushion the mooring process, and a water seal 368 is provided to maintain watertight integrity of the vessel fluid transfer system (FTS) compartment 400. Buoy 362 is geostationarily moored to the sea floor by anchor legs 364 via anchor leg connectors 363. A flexible fluid conduit 369 is suspended by buoy 362 to provide a fluid flow path between a subsea well, pipeline or component and vessel 401. Flexible conductor 369 connects to the vessel fluid conduit 353 via fluid swivel 354.

Referring to FIG. 5, structural connector 361 has an first face 480 connected to the turret 415, a complementary second face 482 that interlocks with the first face, which is connected to the mooring buoy 362, and a plurality of collet segments 390 that are circumferentially positioned around the structural connector 361 for dogging the two faces 480, 482 together. Each collet segment 390 moves radially in and out and has an inward-facing lip for engaging the first and second faces 480, 482. The structural connector 361 is described in greater detail in co-pending U.S. patent application Ser. No. 60/749,469 filed on Apr. 24, 2006, which is incorporated herein by reference.

FIG. 5 also illustrates a chain tension device 500 disposed above connector 361 that pulls buoy 362 tightly in metal-to-metal contact (at 502) against vessel 401. In one final short stroke, chain tension device 500 advantageously pulls buoy 362 tight against the bottom of the bearing table 502, compresses the water seals 368, and holds the buoy tight to vessel 401 while the connector 361 engages to complete a preloaded connection. Chain tension device 500 increases the pull-in tension on the chain 504 (the pull force about doubles that available from a rope winch) to allow connection in rough seas. Chain tension device 500 is not a conventional chain jack, in that it does not cycle to continuously pull up chain links, as it the case for typical mooring system chain jacks.

FIG. 5 also illustrates a quality control/damage control (QC/DC) compartment 510 located inside buoy 362, extending below keel 366 of vessel 401.

In all of the embodiments illustrated by FIGS. 3-5, the flexible tube 130, 230, 430, which permits deformation at one end without passing along deformation forces to the rigid ring 113, 213, 413, need not be higher than necessary to achieve the required levels of damping for the intended installation, but it can extend the entire height of the chamber and provide a mounting for an upper radial bearing near the upper end of the rotary tube, if desired. That is, in addition to the lower axial/radial bearing 113, 213, 413, an optional second radial bearing may be provided at an upper portion of the turret 116, 215, 415. This radial bearing can, however, be omitted, depending on the rigidity and height of the rotary tube.

The Abstract of the disclosure is written solely for providing the United States Patent and Trademark Office and the public at large with a way to determine quickly from a cursory reading the nature and gist of the technical disclosure, and it represents solely one or more preferred embodiments and is not indicative of the nature of the invention as a whole.

While some embodiments of the invention have been illustrated in detail, the invention is not limited to the embodiments shown; modifications and adaptations of the above embodiments may occur to those skilled in the art. Such modifications and adaptations are in the spirit and scope of the invention.

What is claimed is:

1. A mooring arrangement comprising, a vessel (102) having a substantially rigid structure (103) which extends from keel (107) to upper deck (105) of said vessel (102) forming a chamber (106) in said vessel, a relatively flexible tube (130) mounted to said keel (103) with an upper end (118) of said tube (130) extending upwardly into said chamber (106) and with a lower end of said tube (130) mounted at an opening to the sea where said tube is mounted to said keel (107), a substantially rigid ring (113) mounted to said upper end (118) of said relatively flexible tube (130), and a turret (115, 116) arranged and designed to be anchored to a sea floor and disposed coaxially within said tube (130), said turret (115, 116) rotatively mounted to said rigid ring (113) via a bearing arrangement (117), whereby, said vessel is enabled to weathervane about said turret (115, 116) when said turret (115, 116) is anchored to said sea floor, and ovaling forces of said substantially rigid structure (103) are limited from transfer to said substantially rigid ring (113) by said relatively flexible tube (130).

2. The arrangement of claim 1 wherein said bearing arrangement includes an outer race mounted on said substantially rigid ring (113) and an inner race mounted on said turret (115, 116).

3. The arrangement of claim 1 wherein, said turret (115, 116) is detachably connected to a mooring buoy (119), said mooring buoy having anchor legs arranged and designed to allow the buoy to sink beneath the sea to a stable depth, so that retrieval and reconnection of said vessel to said buoy (119) is facilitated.

4. The arrangement of claim 1 further comprising, at least one conduit (125) carried by said turret (115, 116), a fluid swivel (139) mounted on said turret (115, 116) and disposed within said chamber, said swivel (139) providing fluid communication between said conduit (125) and a conduit (137) connected to the vessel (102).

5. The arrangement of claim l further comprising, a hull plate (132) fixed to said keel (107) and connected to said lower end of said relatively flexible tube (130), said hull plate transferring ovaling deformation forces from said vessel (102) to said lower end of said relatively flexible tube (130).

6. The arrangement of claim 1 wherein, said bearing arrangement includes both axial and radial bearings.

* * * * *